United States Patent [19]

Bergmann et al.

[11] 4,442,684

[45] Apr. 17, 1984

[54] CONTROL OF WEFT THREAD INSERTION

[75] Inventors: Gerhard Bergmann, Heusenstamm; Gerhard Hittel, Rodgau, both of Fed. Rep. of Germany

[73] Assignee: Karl Mayer Textilmaschinenfabrik GmbH, Obertshausen, Fed. Rep. of Germany

[21] Appl. No.: 398,202

[22] Filed: Jul. 14, 1982

[30] Foreign Application Priority Data

Jul. 16, 1981 [DE] Fed. Rep. of Germany ..... 3128024

[51] Int. Cl.[3] ..... D04B 23/06

[52] U.S. Cl. ..... 66/84 A

[58] Field of Search ..... 66/84 A

[56] References Cited

U.S. PATENT DOCUMENTS

| | | | |
|---|---|---|---|
| 3,705,503 | 12/1972 | Skopalik et al. | 66/84 A |
| 3,771,330 | 11/1973 | Carman | 66/84 A |
| 3,774,414 | 11/1973 | Vogel | 66/84 A |
| 3,797,278 | 3/1974 | Kohl | 66/84 A |
| 4,220,020 | 9/1980 | Kohl | 66/84 A |
| 4,255,947 | 3/1981 | Kohl | 66/84 A |
| 4,348,876 | 9/1982 | Roth | 66/84 A |

*Primary Examiner*—Ronald Feldbaum
*Attorney, Agent, or Firm*—Omri M. Behr

[57] ABSTRACT

A weft thread insertion magazine in a warp knitting machine has a pair of separated forwarding chains driven by a drive arrangement. These forwarding chains each have equidistant holders for holding transversely placed weft threads. The drive arrangement can provide the forwarding chains with a lower speed than the normal speed at which weft threads are provided to the needles, that is, at a rate less than one thread per needle cycle. In particular the drive shaft of the warp knitting machine may be connected to the forwarding chains by means of a revolution reducing arrangement. A control arrangement regulates the separation of at least the first weft thread from the others following and the presentation of this first one into the vicinity of the knitting needles. This control arrangement comprises either a weft thread presenter, a weft thread deflector or a combination of both. The control mechanism only activates the weft thread presentation or deflection during a portion of the appropriate needle cycle. In this manner the pattern repeat can be substantially increased.

19 Claims, 5 Drawing Figures

CONTROL OF WEFT THREAD INSERTION

BACKGROUND OF THE INVENTION

1. Field of the Invention

The present invention relates to warp knitting machines having a weft thread magazine comprising a pair of separated weft thread forwarding means. These forwarding means have, in the drive direction, a plurality of equidistantly spaced holding means for transversely placed weft threads. Machines of this type may include weft threads presentation means activated by a control arrangement for separating the first weft thread from the others following and presenting the first thread in the vicinity of the needles.

2. Discussion of the Relevant Art

In a known warp knitting machine of this type (Mayer warp knitting automatic or Raschel machine with weft thread magazine KS2MSU or RS4MSU) the forwarding means are driven with a normal speed, that is, at a rate such that one weft thread is presented to the needles at each needle cycle. The weft thread presenting means are activated at each needle cycle to engage and present a weft thread to the needles. When the holders of the forwarding means carry weft threads, each is knotted into each stitch row. The weft threads are layed into the forwarding means by thread guides on a reciprocating carrier which moves back and forth between the forwarding means. Within this group of thread guides different weft threads may be employed or, equally, certain positions may be left unused. The pattern repeat is however limited to the number of thread guides.

It is already known (German patent application OLS No. 2401050) that the pattern repeat can be increased by altering the weft threads fed to the thread guides. In this mode, new weft threads are knotted onto old weft threads. In accordance with an older suggestion (German application No. P3040393) at least two thread guide groups may be provided to the carrier which can be activated or de-activated by choice.

Accordingly, there is a need for an improved warp knitting machine with a weft thread magazine of the above described type. Wherein the pattern repeat in all known forms can be readily increased.

SUMMARY OF THE INVENTION

A warp knitting machine according to the principles of the present invention has a cyclically operable needle bed for producing ware inlayed with weft threads. The machine also has a weft thread insertion means including a pair of spaced forwarding means for carrying the weft threads toward the needle bed. The machine also has a drive means and a plurality of holders. The holders are separately mounted equidistantly on each of the pair of forwarding means for holding transversely positioned, spaced sequences of the weft threads. The drive means is coupled to the pair of forwarding means and is operable to drive them at an arrival rate equal to or less than one weft thread per cycle of the knitting machine.

By employing apparatus of the foregoing type, an improved knitting machine is provided in that the drive arrangement for the weft thread forwarding means may operate at a speed less than the usual speed at which the weft threads would be presented to the needles, that is, slower than every needle cycle. Furthermore, the control arrangement controlling weft thread presentment is only activated during a portion of an appropriate needle cycle.

The achievement of the lower running speed of the weft thread forwarding means may be provided from a form of warp knitting machine in which the drive arrangement has a drive shaft which is driven from the main shaft of the warp knitting machine with a number of revolutions corresponding to normal speed. It is thereby sufficient to connect the forwarding means with this drive shaft via a revolution reduction arrangement.

In a preferred arrangement a weft thread presenter separates a leading thread from a weft thread forwarder and presents this thread to the needle bed. In this arrangement a weft thread deflector can remove the weft thread to a remote position and thus delay its presentment to the needle bed. The presenter and/or the deflector can therefore time the arrival of weft threads. It is preferable to time the operation of the deflector and/or presenter by a timing chain whose projections are preset to establish the desired pattern of weft thread delivery. The chains can run at the usual or a reduced speed.

BRIEF DESCRIPTION OF THE DRAWINGS

In order that the invention may be more fully understood, it will now be described, by way of example, with references of the accompanying drawings in which.

DESCRIPTION OF THE PREFERRED EMBODIMENTS

Figure 1:
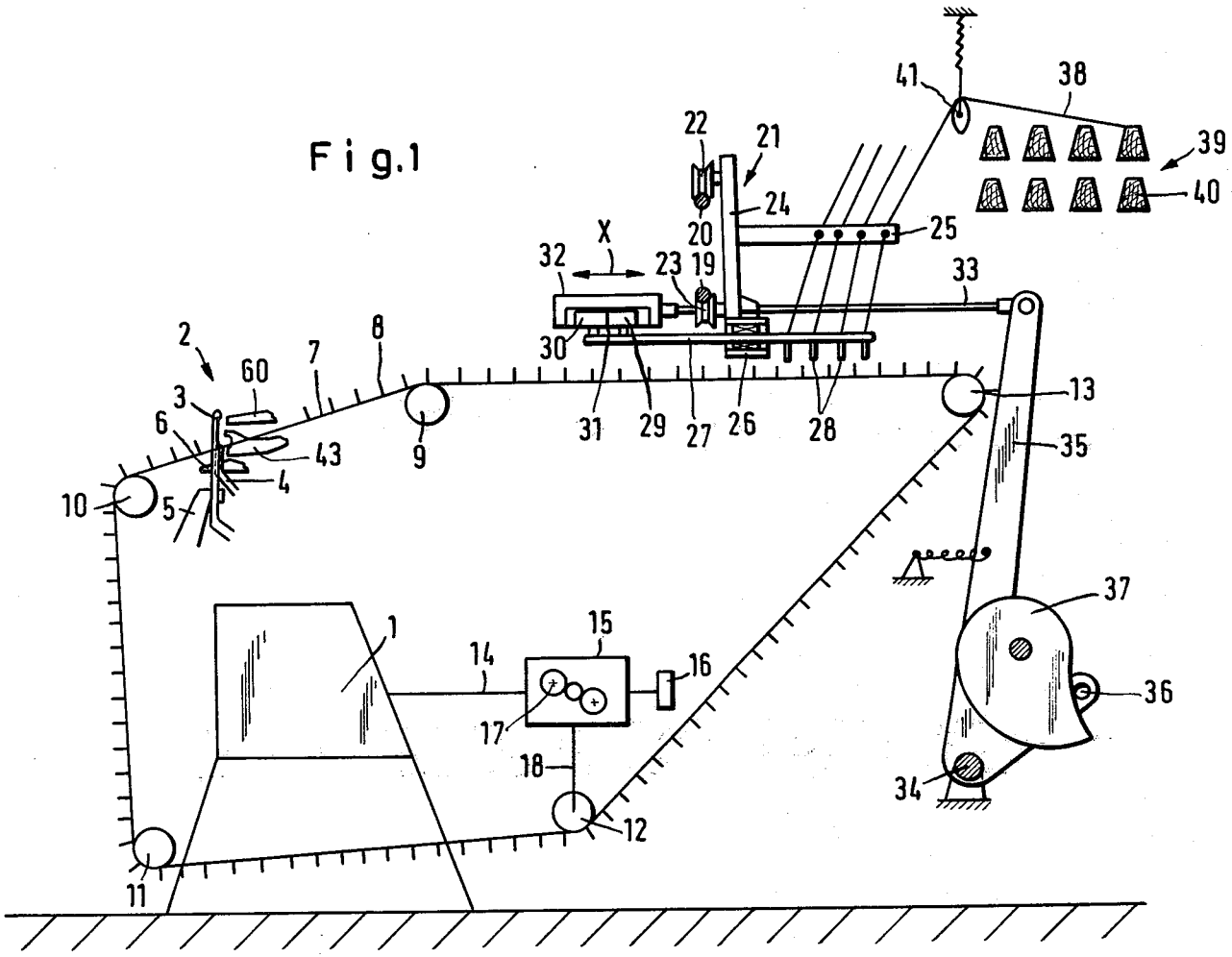
FIG. 1 is a schematic side view of a weft thread magazine and other parts of a warp knitting machine, according to the present invention.

The warp knitting machine of FIG. 1 comprises machine frame 1 and its working area 2 comprising needles 3, slider 4, knockover sinkers 5 and needle holders 6. Elements 3–6 are supported to allow reciprocation in the usual manner so that warp threads (not shown) may be knitted together, one course for each cycle of needles 3. On opposite sides of the needle bed there are provided forwarding means 7 equipped with a plurality of equally spaced holders 8. The forwarding means 7 are generally speaking, formed from a pair of endless, parallel chains. Holders 8 are preferably upright members terminating in a knob, hook or other thread holding device. Forwarding chains 7 travel over a plurality of rollers 9, 10, 11, 12 and 13 in that order and direction. Roller 12 is power driven by output drive shaft 18. The revolutions of drive shaft 14 depend upon the main shaft of the warp knitting machine 1 to which it is connected. A drive means is shown herein as shaft 14 driving revolution reduction means 15 which further comprises a setting arrangement 16. Arrangement 16 thus serves as an adjusting means and has two internal wheels 17 which form a switching drive. Alternatively, arrangement 16 may comprise a changable gear drive or a continuously adjustable drive. The output of arrangement 15 is output shaft 18 which connects with and drives roller 12.

Mounted in a direction transverse to chains 7 are two parallel, spaced rails 19 and 20 supporting carriage 21 by its running wheels 22 and 23. So mounted, carriage 21 can reciprocate transversely to forwarding means 7, in a backwards and forwards motion. Running wheels 19 and 20 are journalled onto frame 24 which supports beam 25 having a plurality of spaced thread guides. Frame 24 has a lower bushing 26 slidably supporting rod 27. Rod 27 is in the form of a reciprocating carrier which moves in the direction of arrow "X" and from which several thread guides 28 depend. Two horizontal, longitudinally aligned rollers 29 and 30 are connected to carrier 33 on its end opposite guides 28 (on the same side of bushing 26 as working area 2). Rollers 29 and 30 straddle and engage transverse steel band 31 which at each end thereof is tensioned in holding arrangements 32, cowl-like devices, at least one connected to lever 35 via rod 33. Lever 35 is rotatable about axis 34 and pivotally connected to rod 33 which moves arrangement 32 backwards and forwards. Rotatably mounted on a lower branch of lever 35 is roller 36. Roller 36 runs on the perimeter of cam disc 37 which rotates at a speed proportional to the cycling rate of machine 1. Simultaneously, carriage 21 moves in the transverse direction. A plurality of weft threads 38 unwound from group 39 of spools 40 are led to thread guides 28 via guide means in beam 25. The tension to the threads is provided by spring-biased tension rollers 41 between beam 25 and spools 40. In this manner "n" weft threads are led by a transverse motion from "n" holders 8 in one forwarding means 7 to "n" holders in the other forwarding means 7. The subsequent relative motion between guides 28 and forwarding means 7 causes relative displacement of "n" holder spaces and subsequently leads to looping threads 38 around another "n" holder upstream in the first mentioned forwarding means.

Figure 2:
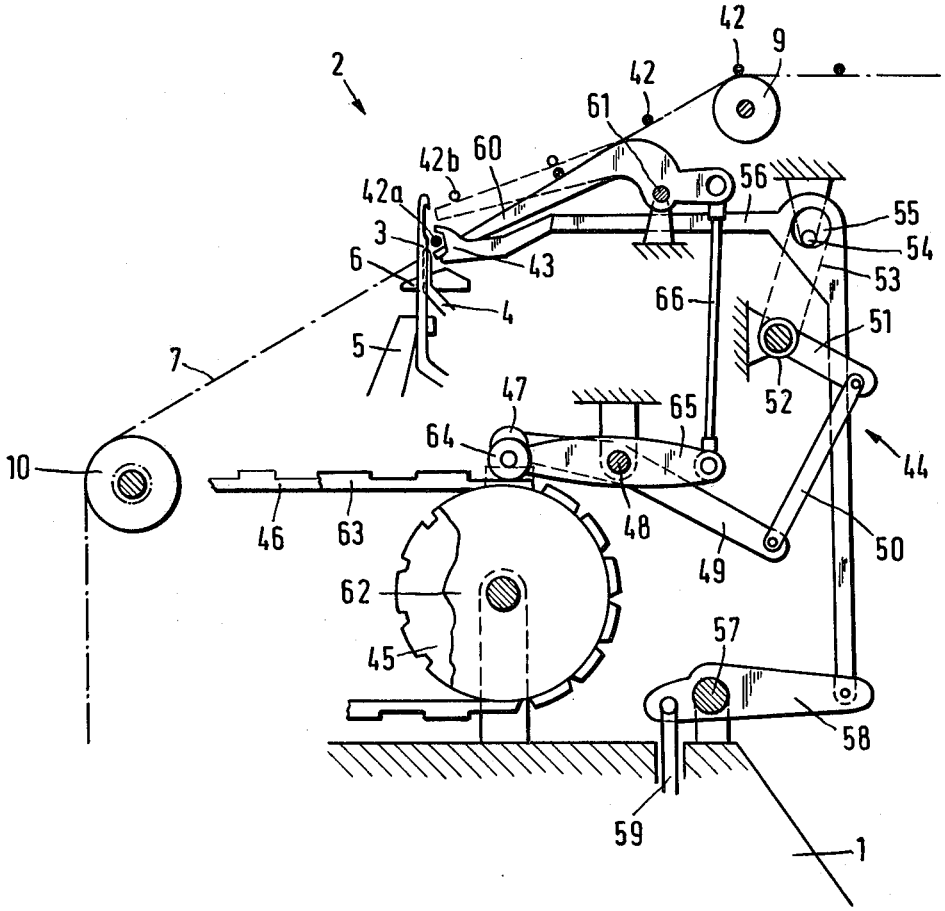
FIG. 2 is a more detailed schematic side view of the knitting arrangement, control means of the weft thread presenter and the weft thread deflectors of FIG. 1.

FIG. 2 illustrates the position of the weft threads 42 on the forwarding means 7 as placed on the holders 8, in the vicinity of work area 2. The illustrated forwardmost weft thread **42*a* is separated from the subsequently following weft threads 42 by means of weft thread presenter 43. Presenter 43, as explained further hereinafter, can move on a closed path to engage thread 42*a* and present it to needles 3. A control means 44 provides that at least occasionally, weft thread presenter 43** is activated during just part of an appropriate needle cycle.

A first part of this control arrangement 44 comprises a pattern means in the form of drum 45 whose rate of rotation is controlled by the main shaft of machine 1. Encircling drum 45 is an appropriate chain 46 having preselected outer ridges and encircling another wheel (not shown). The protrusions of chain 46 displace swingable lever 49 about fixed axis 48 by means of contact roller 47 journalled on the proximal end of lever 49. The other distal end of lever 49 is connected with a second lever 51 via articulating rod 50. Lever 51 rotates toothed wheel 52. Said toothed wheel 52 rotates rotatable eccentric cam 55 about fixed axis 54 by means of chain 53.

Angle lever 56 has an inverted "L" shape with its upper end carrying weft thread presenter 43. The other end of lever 56 cooperates with drive rod 59. Lever 56 is rotatable about eccentric cam 55. Lever 56 is operated via its lower end which pivotally connects to lever 58, the latter being rotatable about axis 57. The drive rod 59 pivotally connects to the end of lever 58 opposite the lower end of lever 56. Drive rod 59 is connected with the main shaft of warp knitting machine 1 via an eccentric cam (not shown) so that an upward and downward movement is provided for each cycle and thus the thread provider 43 periodically protrudes between the weft threads 42. The pattern chain 46 is so provided that the presentation movement of the weft thread presenter 43 does not occur at each needle cycle. Thus, the weft thread providers are only activated during a portion of the needle cycle.

Also instead of the mechanism just described employing eccentric cam 55, a multiple lever arrangement can be used. An example of a multiple lever arrangement is given in U.S. Ser. No. 312,744; (patent application).

A second portion of control arrangement 44 comprises weft thread deflector 60 which is rotatable mounted about fixed axis 61 and may be rotated out of the totally inactive setting shown into the setting noted in phantom wherein at least the forwardmost of the weft threads **42*b* is lifted so far that it finds itself outside the presentation path of the weft thread presenter 43. For this purpose there is provided a second pattern drum 62 coaxially mounted with drum 45 and preferably driven at the same speed. Drum 62 has an appropriate pattern chain 63 which is contacted by contact roller 64 rotatably mounted on lever 65. Lever 65 is also rotatably mounted on axle 48 and has on the end opposite roller 64, a pivotal connection to rod 66. Motion is transferred to weft thread deflector 60 by means of rod 66, pivotally connected to the end of deflector 60 distal from needles 3**.

Pattern chains 46 and 63, pattern chain drums 45 and 62 as well as the drive taken off from the main shaft comprise the normal arrangements for weft thread machines.

In operation, the speed of forwarder 7 can be set to a slower speed than usual, that is, slower than one weft thread 42 being provided to needles 3 for each cycle. This speed is set by setting means 16 of adjustable reduction arrangement 15. It is particularly desirable to provide a speed of 1/p of the normal speed where p is an integer. At the same time there is provided a coupling of the control arrangement 44 to this reduced speed. The pattern chains 46 and 63 thus serve as a coordination arrangement.

Figure 3:
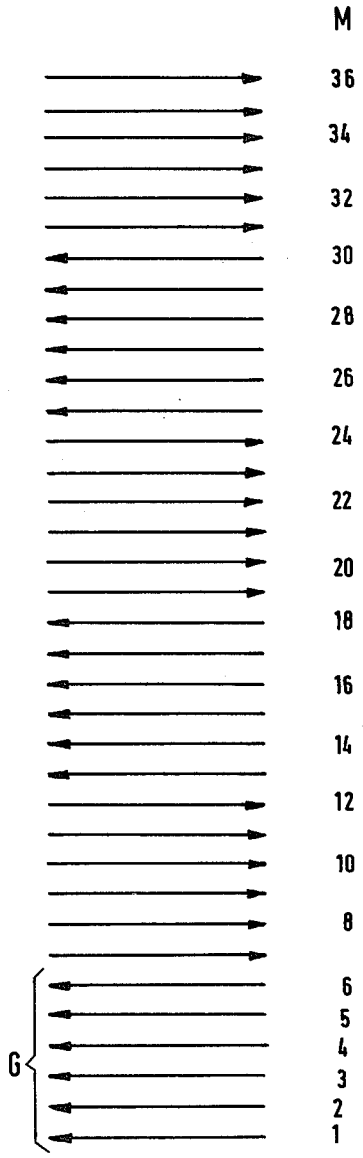
FIG. 3 is a lapping diagram of the prior art.
Figure 4:
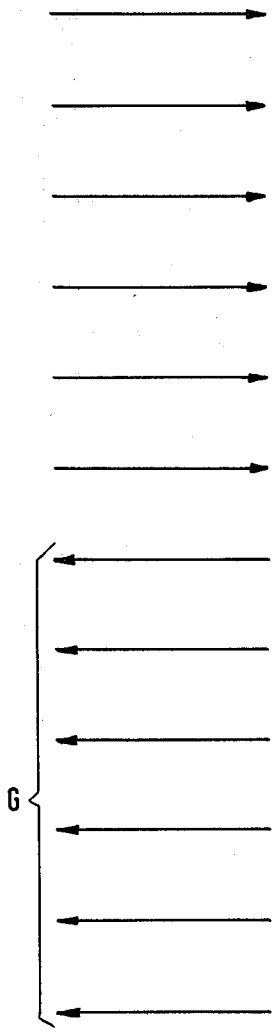
FIG. 4 is a lapping diagram obtainable in one variation of the present invention.
Figure 5:
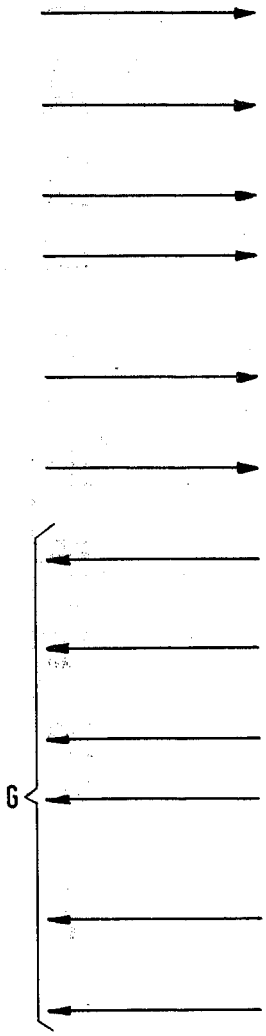
FIG. 5 is another lapping diagram obtainable in another variation of the present invention.

For example, certain arrangements as illustrated by FIGS. 3–5 are possible.

In the lapping diagrams the groups G are illustrated as comprising 6 weft threads which show the pattern repeat. As a matter of practicality, group G could comprise up to 24 weft threads. The single arrows show by their direction the movement path of carrier 21 while laying the weft threads. Their conjunction with stitch rows "M" show which stitch rows are provided with weft threads and which are weft-thread free.

The working mode of FIG. 3 shows the usual situation. The reduction drive 15 is so set that the output shaft 18 has the same number of revolutions as the input shaft 14. The forwarders 7 move at the usual speed in which the needles 3 are provided with a weft thread 42 at each cycle. The pattern chain 46 comprises a high spot for each needle cycle, in order to bring the weft thread provider 43 into the presentation path. The pattern chain 63 has no raised portions. Therefore prior to each stitch cycle of needles 3, presenter 43, in response to motion by rod 59 protrudes between the weft threads, entering behind forwardmost thread **42*a*. Due to the concurrent action of pattern chain 46, cam 55 is activated so that presenter 43 moves into the vicinity of needles 3 which subsequently perform a stitch. As a result weft thread 42 is laid into the knitted ware in the usual fashion. The presenter 43 then retreats to a position at which the next weft thread 42 can be engaged. Weft thread deflectors 60 always remain in their position shown by continuous lines. This gives rise to the weft thread arrangement in accordance with FIG. 3** in which each stitch row is provided with a weft thread and the pattern repeats itself after six stitch rows.

It is particularly advantageous to provide that the drive arrangement 15 may provide several different speeds by means of a setting arrangement 16 and that the arrangement 44 may be adjusted to each speed by means of an adjusting arrangement. The drive arrangement 15 should be preferably settable to not only the usual drive speed but a lesser drive speed. Thus, by changing the setting the pattern repeat may be appropriately changed as described presently.

In the embodiment of FIG. 4 the reduction drive 15 is so set that the number of revolutions of the drive shaft 18 comprises only one third of the number of revolutions of shaft 14. The forwarding means 7 thus move at approximately ⅓ of the normal speed and present a weft thread only every third cycle of needles 3. The pattern chain 46 comprises raised portions in such a distance from each other that the weft thread presenter 43 only moves into the presentation path at every third needle cycle. Pattern chain 63 comprises such a number of raised portions that weft thread deflector 60 generally finds itself in the position indicated in phantom position and only descend at every third needle cycle to the position shown by solid lines. Only when deflector 60 and forwardmost thread **42*b* resting thereon descend, can weft thread provider 43 interact with thread 42*b*** and carry it forward. Otherwise threads near but not ready to be inlayed are held out of the needles. There is thus provided a lapping diagram wherein only every third stitch row is provided with weft threads.

In this construction the pattern repeat is increased so that there are provided weft thread free stitch rows even though each holder on the forwarding means 7 is provided with a weft thread. When, for example, a weft thread 42 is knotted in only at each third needle cycle the pattern repeat is increased threefold. This aim is achieved through the lower drive speed of forwarding means 7 and the special control of the thread presenter 43 which only grasps and present a thread when the knotting-in of a weft thread 42 is actually desired. This arrangement is also possible when weft threads are changed thru knotting or shifting of the thread guides (see German OLS No. 2401050 and U.S. Ser. No. 312,744 respectively).

Since a weft thread is not presented at each cycle there is no accumulation of thread 42 if the weft thread presenter 43 does not operate during each cycle. Also, the presenter 43 does not always have to grasp the threads 42 at the same place. It is sufficient if it is grabbed anywhere in the presentation path.

In the foregoing preferred embodiment the drive arrangement 7 is adjustable to an intergral proportion of the usual drive speed, so that the weft threads are knotted into every second, third or the like stitch row. By means of appropriate adjustment of the control arrangement it is also possible to work with intermediate values of the speed and then for example, provide for different separations between subsequent weft threads.

In the embodiment of FIG. 5 the speed of forwarders 7 is unchanged (⅓ of the usual speed). The pattern chain 46 controls the weft thread providers so that at the third, sixth, tenth, twelfth, fifteenth and eighteenth needle cycle a weft thread presentation movement occurs. In a similar manner pattern chain 63 controls weft thread deflector 60 so that only at the named needle cycles is the deflector 60 lowered to the inoperative position shown by solid lines. There is thus provided a pattern repeat in which the number of the weft thread free stitch rows follows the pattern 2,2,3,1,2,2. This basically requires delaying presentment of a weft thread at the ninth cycle. To this end deflector 60 remains raised and presenter 43 is not activated so that no weft thread is laid in during this ninth cycle. In the tenth cycle, however, chain 63 causes deflector 60 to descend and chain 46 activates presenter 43 to carry a weft thread into the vicinity of needles 3. Again, deflector 60 and presenter 43 are operated to present weft threads 42 only at the rows specified above.

There is another possibility wherein the control arrangement 44 relies primarily on the weft thread deflector 60 which can be similarly activated by its pattern drive 63. At least any first thread **42*a* is held outside the presentation path of the thread presentation means 43 by assistance of such a thread deflector. The action of the thread presenter 43 within a particular time span, may be delayed. It is even possible to execute a presentation movement of the weft thread presenter 43** during each needle cycle and at the same time maintain weft thread free stitch rows.

The foregoing apparatus found it particularly advantageous if the reducing means 15 is utilized as the setting means. For example, the setting means may be a switch gear. It may also comprise a change gear drive. In some cases a continually adjustable drive may be advantageous. However, other arrangements are possible wherein speeds are changed by hydraulic, electromechanical or other means. Also while a pattern chain drive is preferred as the control arrangement, other devices which, by predetermined choice, activates or suppresses the presentation movement of the weft thread presenter 43 are possible. A very simple way of activating the weft thread presenter 43 has been illustrated although more complex systems can be devised.

It will be understood that various changes in the details, materials, arrangement of parts and operating conditions which have been herein described and illustrated in order to explain the nature of the invention may be made by those skilled in the art within the principles and scope of instant invention.

Having thus set forth the nature of the invention, what is claimed is:

1. A warp knitting machine having a cyclically operable needle bed for producing ware inlayed with weft threads and having a weft thread insertion means comprising:

a pair of spaced forwarding means carrying said weft threads toward said needle bed;

a weft thread deflector mounted adjacent to and up stream of said needle bed for deflecting the forwardmost one of said weft threads to prevent its reaching said needle bed;

a plurality of holders separately mounted equidistantly on each of said pair of forwarding means for holding transversely positioned, spaced sequences of said weft threads;

drive means coupled to said pair of forwarding means and control means for said forwarding means to provide a weft thread arrival rate at the needle bed of less than one weft thread per cycle of said knitting machine.

2. A warp knitting machine according to claim 1 wherein said weft thread insertion means comprises:

control means for engaging upstream of said needle bed the forwardmost one of said weft threads to regulate its arrival into the proximity of said needle bed.

3. A warp knitting machine according to claim 2 wherein said control means is operable to separate said forwardmost one of said weft threads from the others upstream and present said forwardmost one into the proximity of said needle bed.

4. A warp knitting machine according to claim 3 wherein said control means is operable to present said forwardmost one of said weft threads at a delivery rate of less than one weft thread per cycle of said knitting machine.

5. A warp knitting machine according to claim 4 wherein said machine has a main shaft and wherein said drive means comprises:

a revolution reducing means having an input and output shaft connected to said main shaft and said forwarding means, respectively.

6. A warp knitting machine according to claim 5 wherein said drive means comprises:

an adjusting means for varying the speed ratio between the input and output shaft of said drive means, said control means including:

an adjusting arrangement for adjusting said delivery rate to correspond to the arrival rate of said forwarding means.

7. A warp knitting machine according to claim 1 wherein said arrival rate of said drive means is adjustable to one weft thread per cycle and less.

8. A warp knitting machine according to claim 5 wherein said reducing means provides variable reduction.

9. A warp knitting machine according to claim 8 wherein said reducing means comprises a switching gear.

10. A warp knitting machine according to claim 8 wherein said reducing means comprises a gear changing arrangement.

11. A warp knitting machine according to claim 8 wherein said reducing means comprises a continuously adjustable driver.

12. A warp knitting machine according to claim 1 wherein said drive means is operable to set said arrival rate of the weft threads per cycle of said machine at 1/p, p being a plurality of integers including one.

13. A warp knitting machine according to claim 4 wherein said control means comprises:

presenting means for engaging said forwardmost one of said weft threads and presenting it to said needle bed; and pattern means driven at a rate proportional to the delivery rate and coupled to said presenting means for periodically activating and suppressing its motion to present the weft threads.

14. A warp knitting machine according to claim 1 further comprising:

a pattern driver driven at a rate proportional to the arrival rate and coupled to said deflector for timing its deflection.

15. A warp knitting machine according to claim 1 wherein said machine has a main shaft and wherein said drive means comprises:

a revolution reducing means having an input and output shaft connected to said main shaft and said forwarding means, respectively.

16. A warp knitting machine having a cyclically operable needle bed for producing ware inlayed with weft threads and having a weft thread insertion means comprising:

a pair of spaced forwarding means for carrying said weft threads toward said needle bed;

a plurality of holders separately mounted equidistantly on each of said pair of forwarding means for holding transversely positioned, spaced sequences of said weft threads;

drive means coupled to said pair of forwarding means and operable to drive them at an arrival rate at the needle bed of one and less than one weft thread per cycle of said knitting machine;

presenting means for engaging said forwardmost one of said weft threads and presenting it to said needle bed at a given delivery rate; and pattern means driven at a rate proportional to the delivery rate and coupled to said presenting means for periodically activating and suppressing its motion to present the weft threads.

17. A warp knitting machine having a cyclically operable needle bed for producing ware inlayed with weft threads and having a weft thread insertion means comprising:

a pair of spaced forwarding means for carrying said weft threads toward said needle bed;

a plurality of holders separately mounted equidistantly on each of said pair of forwarding means for holding transversely positioned, spaced sequences of said weft threads;

drive means coupled to said pair of forwarding means and operable to drive them at an arrival rate at the needle bed of one and less than one weft thread per cycle of said knitting machine, and a weft thread deflector mounted adjacent to and upstream of said needle bed for deflecting the forwardmost one of said weft threads to prevent its reaching said needle bed.

18. A warp knitting machine according to claim 17 wherein said machine has a main shaft and wherein said drive means comprises:

a revolution reducing means having an input and output shaft connected to said main shaft and said forwarding means, respectively.

19. A warp knitting machine according to claim 18 wherein said deflector is operable to deflect said forwardmost one of said weft threads at a delivery rate of one and less than one weft thread per knitting cycle of said knitting machine and wherein said drive means comprises:

an adjusting means for varying the speed ratio between the input and output shaft of said drive means; and an adjusting arrangement for adjusting said delivery rate to correspond to the arrival rate of said forwarding means.

* * * * *